US006906294B2

(12) United States Patent
Yang

(10) Patent No.: US 6,906,294 B2
(45) Date of Patent: Jun. 14, 2005

(54) COMPOSITE COOKING APPARATUS AND METHOD OF CONTROLLING THE SAME

(75) Inventor: Ha-Yeong Yang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/691,708

(22) Filed: Oct. 24, 2003

(65) Prior Publication Data

US 2004/0222217 A1 Nov. 11, 2004

(30) Foreign Application Priority Data

May 7, 2003 (KR) ..... 10-2003-0029103

(51) Int. Cl.[7] ..... H05B 6/12
(52) U.S. Cl. ..... 219/620; 219/622
(58) Field of Search ..... 219/620, 622, 219/621, 601, 623, 624, 627, 630, 632, 635, 675, 677, 494, 510, 398; 126/299 D, 21 R, 37 R; 363/136, 124

(56) References Cited

U.S. PATENT DOCUMENTS 3,790,735 A * 2/1974 Peters, Jr. ..... 219/622
4,996,405 A * 2/1991 Poumey et al. ..... 219/624
6,008,482 A * 12/1999 Takahashi et al. ..... 219/687
6,660,981 B2 * 12/2003 Ogata et al. ..... 219/622

FOREIGN PATENT DOCUMENTS

JP 01070619 A * 3/1989 ..... F24C/7/02
JP 02213086 A * 8/1990 ..... H05B/11/00

OTHER PUBLICATIONS

Patent Abstract of Japan, Publication No. 4–055626, Publication Date Feb. 24, 1992.

* cited by examiner

*Primary Examiner*—Quang T. Van
(74) *Attorney, Agent, or Firm*—Staas & Halsey LLP

(57) ABSTRACT

A composite cooking apparatus, which may perform a heating operation using a plane heater and an induction heating operation using high frequency current together. A composite cooking apparatus of the present invention includes a plane heater and an induction heater installed below a heat resistant glass plate, as a composite heat source. The present invention may automatically determine material of a cooking container, and perform heating and cooking using a heat source suitable for the material of the cooking container. Further, if a rapid cooking mode is set, cooking is performed at high output power using both the two heat sources, thus shortening a cooking time.

24 Claims, 5 Drawing Sheets

COMPOSITE COOKING APPARATUS AND METHOD OF CONTROLLING THE SAME

CROSS-REFERENCE TO RELATED APPLICATIONS

This application claims the benefit of Korean Application No. 2003-29103, filed May 7, 2003, in the Korean Intellectual Property Office, the disclosure of which is incorporated herein by reference.

BACKGROUND OF THE INVENTION

1. Field of the Invention

The present invention relates, in general, to a composite cooking apparatus and method of controlling the same, which performs heating using a plane heater and/or induction heating using high frequency current.

2. Description of the Related Art

Generally, a cooking apparatus which heats and cooks food using a plane heater or other electric heater is advantageous in that it is not relatively affected by the type and material of a container, but it is disadvantageous in that thermal efficiency is poor. A method of heating using a heating element, such as a plane heater, is disclosed in Japanese Patent Laid-open Publication No. 11-121156.

In a cooking apparatus which performs induction heating using high frequency current, thermal efficiency thereof is better than that of a cooking apparatus using an electric heater, but heating may not be performed or thermal efficiency thereof is poor in the case where a glass container or aluminum container is used. Thus, the use of an electrically conductive container is required to enable induction heating to be efficiently performed.

As described above, the cooking apparatus employing a single type of heat source is problematic in that it is restricted by a cooking container if thermal efficiency is to be high, and thermal efficiency is low if it is not restricted by a cooking container.

Further, in the case where a single type of heat source is used, an output power control function is insufficient, such as the output power control function being performed only within a limited range, thus causing the dissatisfaction of a user.

SUMMARY OF THE INVENTION

Accordingly, it is an aspect of the present invention to provide a composite cooking apparatus and method of controlling the same, which improves thermal efficiency at the time of heating and cooking, and it is not restricted by a cooking container.

It is another aspect of the present invention to provide a composite cooking apparatus and method of controlling the same, which may perform a normal cooking mode in which cooking is carried out at normal output power using a single type of heat source, and a rapid cooking mode in which cooking is carried out at high output power using a composite heat source including different types of heat sources.

Additional aspects and advantages of the invention will be set forth in part in the description which follows and, in part, will be obvious from the description, or may be learned by practice of the invention.

The foregoing and/or other aspects of the present invention are achieved by providing a composite cooking apparatus including two different heat sources to heat food in a cooking container, and a controller to control operations of heating and cooking the food by operating any one or both of the two heat sources according to an operating mode.

The heat sources are a plane heater and an induction heater, respectively.

The composite cooking apparatus further includes a heat resistant glass plate to allow the cooking container to be seated thereon, and the plane and induction heaters are mounted below the heat resistant glass plate.

The composite cooking apparatus further includes an air discharge duct to discharge heated air to outside of the composite cooking apparatus. The plane heater is mounted on a top of the air discharge duct, and the induction heater is mounted below the air discharge duct.

The composite cooking apparatus further includes a cooling fan motor mounted in the air discharge duct to forcibly blow air heated by heat radiated from the plane heater.

The composite cooking apparatus further includes a heat insulating material mounted to come into contact with the plane heater in a face-to-face manner to block heat radiated from the plane heater.

The heat insulating material is made of heat resistant material.

The heat insulating material is heat resistant up to a temperature of approximately 500° C.

The heat insulating material is made of material capable of transmitting a magnetic field.

The controller operates both the plane and induction heaters if an operating mode to shorten a cooking time is set.

The composite cooking apparatus further includes a power supply unit to supply driving power to the plane heater, an inverter to supply driving power of a predetermined frequency to the induction heater, and a current detecting unit to detect current of the inverter.

The controller determines a heat source suitable for material of the cooking container depending on the current detected by the current detecting unit.

The controller determines that the cooking container is suitable in induction heating if the detected current is equal to or greater than a set value, while the controller determines that the cooking container is suitable in plane heating if the detected current is less than the set value.

The foregoing and/or other aspects of the present invention are achieved by providing a method of controlling a composite cooking apparatus, the composite cooking apparatus having a plane heater and an induction heater, the method including setting a cooking command, and heating and cooking food in a cooking container by operating any one or both of the two heaters according to the set cooking command.

The composite cooking apparatus control method further includes detecting current of an inverter which supplies driving power to the induction heater, and heating and cooking the food using a heater suitable for the cooking container depending on the detected current.

The composite cooking apparatus control method further includes heating food in the cooking container in an induction heating manner if the detected current is equal to or greater than a set value, while heating the food in the cooking container in a plane heating manner if the detected current is less than the set value.

The composite cooking apparatus control method further includes discharging air heated by the heater to outside of the composite cooking apparatus by driving a cooling fan motor at the time of heating and cooking using the heaters.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
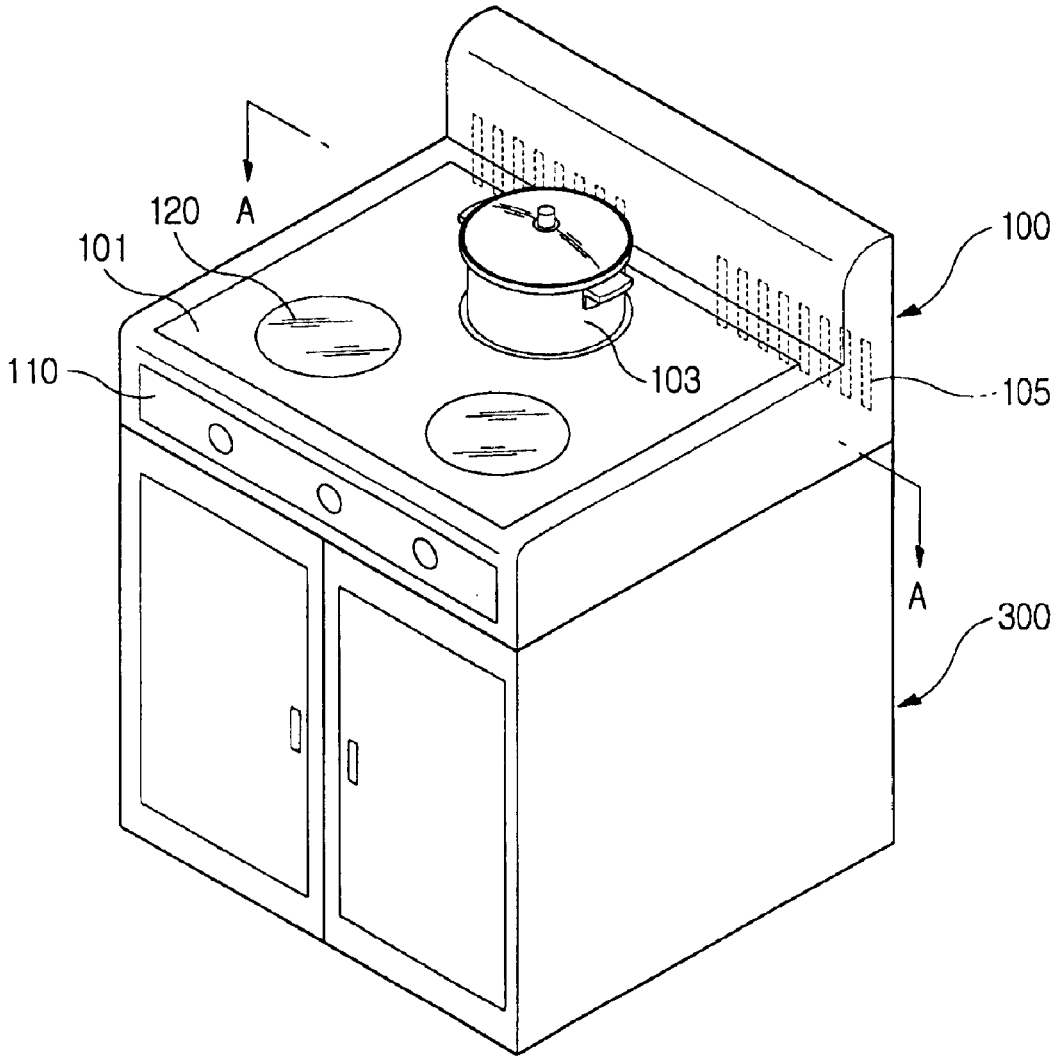
FIG. 1 is a view showing an example in which a composite cooking apparatus, according to an embodiment of the present invention, is used.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Figure 2:
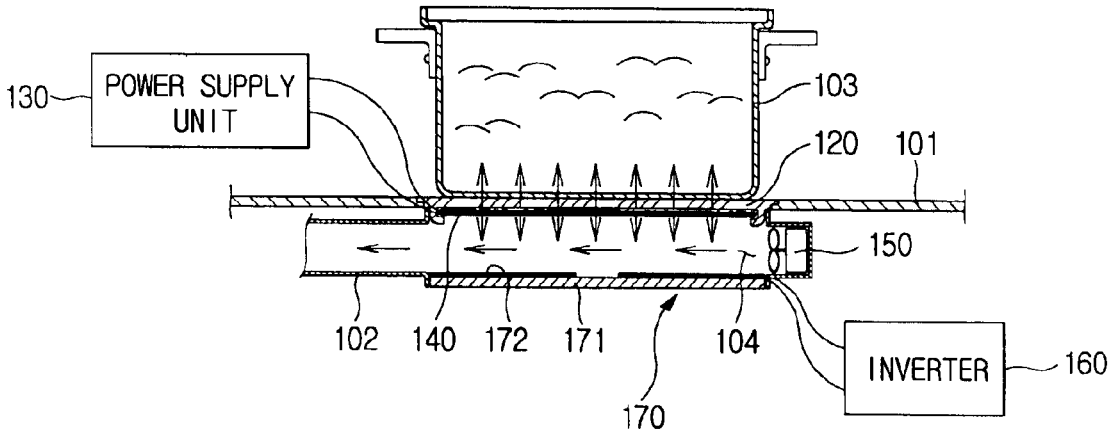
FIG. 2 is a sectional view of the composite cooking apparatus of FIG. 1, according to an embodiment of the present invention.

FIG. 1 is a view showing an example in which a composite cooking apparatus 100, according to the present invention, is used. FIG. 2 is a sectional view of the composite cooking apparatus 100, according to an embodiment of the present invention.

The composite cooking apparatus 100 is capable of cooking using a composite heat source, and is arranged on a top of an auxiliary table 300 which provides a receiving space that receives kitchen utensils. The composite cooking apparatus 100 is provided with a cooking command setting unit 110 arranged on a front thereof to set cooking commands using buttons and knobs. A user may set a desired cooking mode using the cooking command setting unit 110 at the time of heating and cooking.

Heat resistant glass plates 120 are mounted on an upper casing 101 of the composite cooking apparatus 100 to allow a cooking container 103 to be seated thereon to perform heating and cooking, and outlets 105 are formed in a back of the composite cooking apparatus 100 to discharge heated air.

The composite cooking apparatus 100 of the present invention may perform a heating operation using a plane heater and an induction heating operation using high frequency current together. As shown in FIG. 2 illustrating a sectional view taken along line A—A, the composite cooking apparatus 100 has a plane heater 140 and an induction heater 170 arranged below each of the heat resistant glass plates 120, as a composite heat source. The plane heater 140 is mounted on a top of an air discharge duct 102, and the induction heater 170 is mounted below the air discharge duct 102.

Respective heat sources are independently supplied with driving power. A power supply unit 130 supplies driving power (Alternating Current (AC) or Direct Current (DC) power) to the plane heater 140. The induction heater 170 includes a working coil 172 and a support 171. The working coil 172 arranged on the support 171 generates high frequency current depending on driving power of a predetermined frequency, supplied from an inverter 160, and heats food in the cooking container 103 using the high frequency current in an induction heating manner. When the induction heating is performed, a conductive container is used as the cooking container 103.

When the plane heater 140 is operated, the plane heater 140 heats the cooking container 103 seated on the heat resistant glass plate 120 in a plane heating manner, and downwardly radiates heat. Preferably, the working coil 172 is mounted to be spaced apart from the plane heater 140. More preferably, a cooling fan motor 150 is disposed at a portion of the air discharge duct 102 and is driven under the control of a controller, which will be described later, to allow heated air existing in an air path 104 to be forcibly blown, thus preventing the deterioration of the working coil 172 and consequently increasing a life span thereof.

One end of the air discharge duct 102 is connected to the outlets 105, and heated air is guided to the outlets 105 through the air discharge duct 102 to be discharged to the outside of the composite cooking apparatus when the cooling fan motor 150 is operated.

In a normal cooking mode, any one of the two heat sources 140 and 170 may be independently operated to perform heating and cooking, while, in a rapid cooking mode, both the heat sources 140 and 170 may be used to perform heating and cooking. This rapid cooking mode is mainly used when a cooking time is required to be shortened. In the rapid cooking mode, the cooling fan motor 150 is preferably driven together with the two heat sources 140 and 170.

Figure 3:
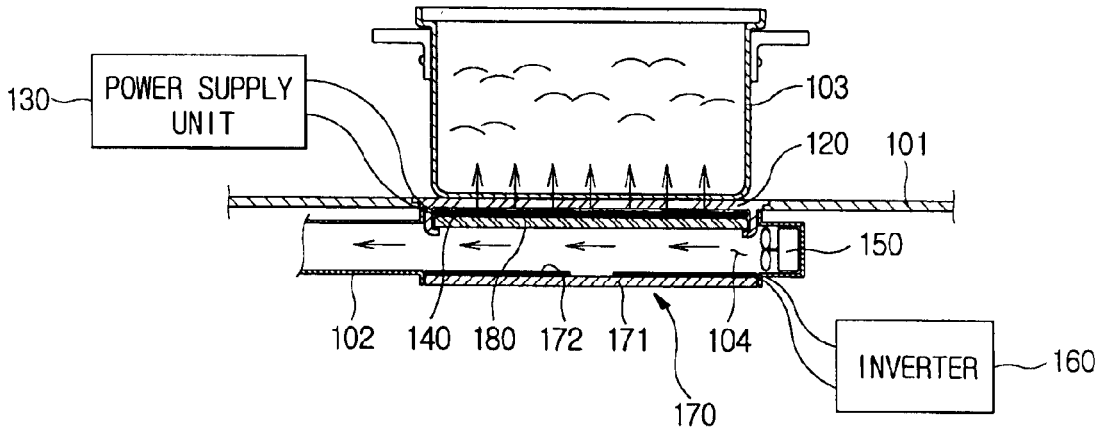
FIG. 3 is a sectional view of the composite cooking apparatus of FIG. 1, according to another embodiment of the present invention.

FIG. 3 is a sectional view of a composite cooking apparatus, according to another embodiment of the present invention. The same reference numerals are used to designate components performing the same functions throughout different drawings.

Referring to FIG. 3, the composite cooking apparatus 100 further includes a heat insulating material 180 mounted below the plane heater 140 to block heat radiated from the plane heater 140.

The heat insulating material 180 comes into contact with the plane heater 140 in a face-to-face manner, so the heat insulating material 180 should be made of material having excellent heat resistance and is capable of transmitting a magnetic field generated by the induction heater 170, that is, high frequency waves. In this embodiment, a heat resistance temperature is approximately 500° C., but it is not limited to 500° C.

Figure 4:
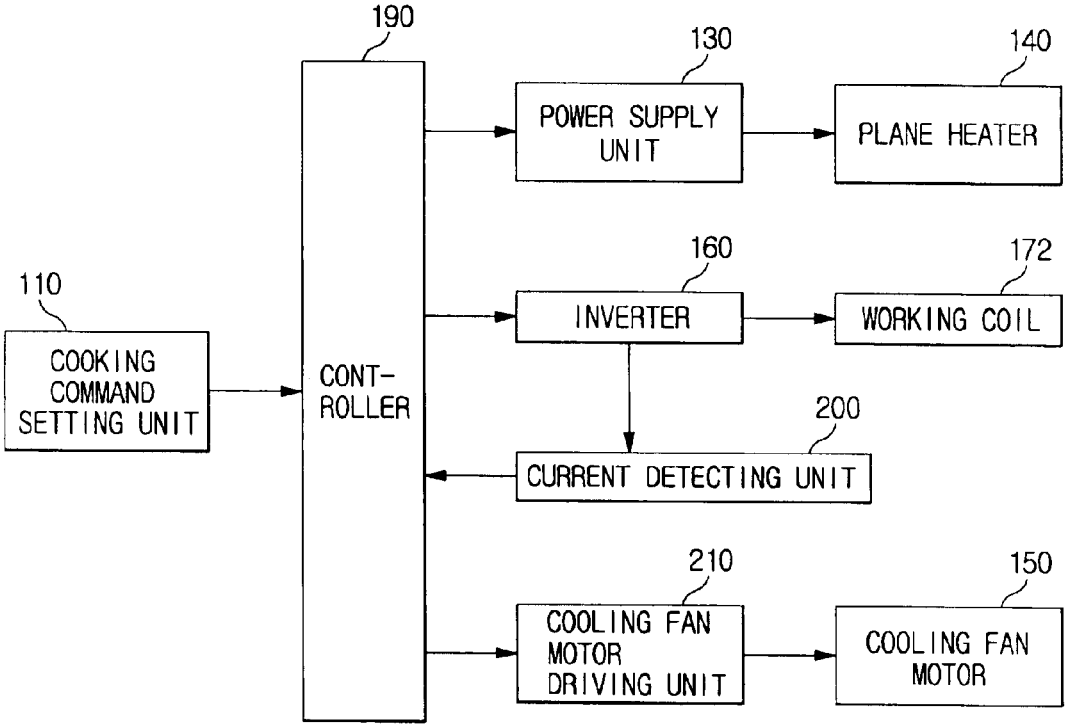
FIG. 4 is a control block diagram of the composite cooking apparatus of the present invention.
Figure 5:
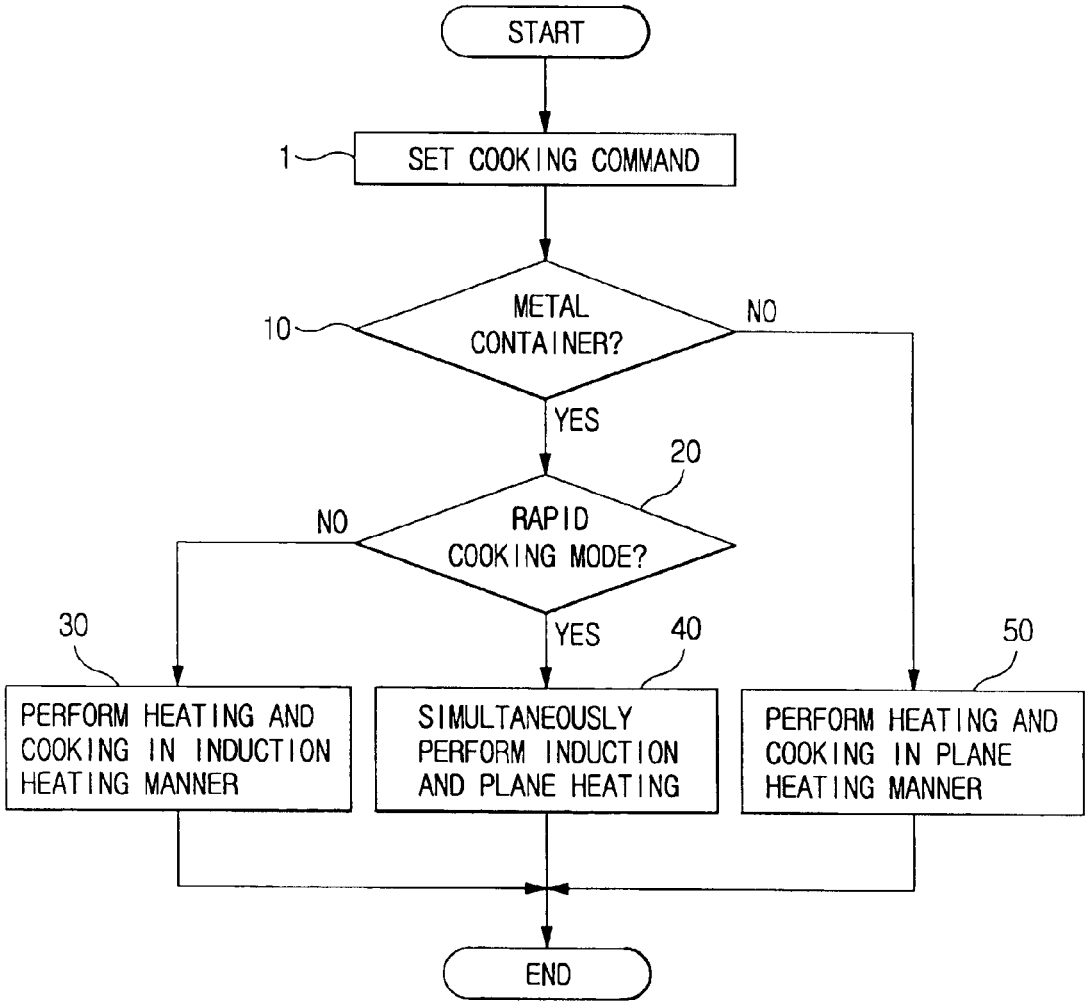
FIG. 5 is a flowchart of a method of controlling the cooking apparatus of the present invention.

FIG. 4 is a control block diagram of the composite cooking apparatus of the present invention.

The composite cooking apparatus of the present invention includes a controller 190 which controls an entire operation of heating and cooking food using the composite heat source. An input terminal of the controller 190 is connected to the cooking command setting unit 110 which sets cooking commands of the user, and a current detecting unit 200 which detects current of the inverter 160. An output terminal of the controller 190 is connected to the power supply unit 130 which supplies driving power to the plane heater 140, the inverter 160 which supplies driving power of a predetermined frequency to the working coil 172, and a cooling fan motor driving unit 210 which drives the cooling fan motor 150.

The controller 190 performs the normal cooking mode or rapid cooking mode according to a cooking command received from the cooking command setting unit 110. The normal cooking mode is an operating mode in which the cooking container 103 is seated on the heat resistant glass plate 120 to perform heating and cooking using any one of the two heat sources, that is, the plane heater 140 or the working coil 172. In this normal cooking mode, if the material of the cooking container 103 is not suitable for induction heating, heating and cooking by the plane heater 140 are automatically performed, while if the material of the cooking container 103 is an electrically conductive metal, the induction heating is automatically performed.

The controller 190 determines whether the material of the cooking container 103 is suitable for induction heating depending on current detected by the current detecting unit 200. That is, when a cooking command is set, the controller 190 controls the inverter 160 to supply driving power of a predetermined frequency to the working coil 172, so high frequency current is generated by the working coil 172. If the current detected by the current detecting unit 200 varies to be equal to or greater than a certain value, the controller 190 determines that the cooking container 103 is made of electrically conductive material and is suitable for the induction heating. On the contrary, if the current detected by the current detecting unit 200 is less than the certain value, the controller 190 determines that the cooking container 103 is not made of electrically conductive material and is not suitable for the induction heating.

If the rapid cooking mode is set by the user, the controller 190 simultaneously operates both the plane heater 140 and the working coil 172 to heat and cook food in the cooking container 103. Further, the composite heat source including the two heat sources is used to perform heating and cooking at high output power, thus shortening a cooking time.

A method of controlling the composite cooking apparatus of the present invention, having the above construction, is described in detail with reference to the attached drawings.

First, the user seats the cooking container 103 on the heat resistant glass plate 120, and then sets a desired cooking command through the cooking command setting unit 110 in operation 1.

If the cooking command is set by the user, the controller 190 controls the inverter 160 to supply driving power of a predetermined frequency to the working coil 172 to perform induction heating. Thereafter, the controller 190 determines whether the cooking container 103 is a metal container, that is, whether the cooking container 103 is made of electrically conductive material, depending on current detected by the current detecting unit 200 in operation 10. If it is determined that the cooking container 103 is not a metal container, the controller 190 operates the plane heater 140 to heat and cook food in the cooking container 103 in operation 50. At this time, the controller 190 controls the cooling fan motor driving unit 210 to drive the cooling fan motor 150 to perform an operation of discharging heated air through the outlets 105. The operation 50 is suitable for the normal cooking mode, but it may be performed even when the user seats the cooking container 103, not made of metal material, on the heat resistant glass plate 120 and sets the rapid cooking mode due to the carelessness of the user.

If it is determined that the cooking container 103 is a metal container in operation 10, the controller 190 determines whether the rapid cooking mode for heating and cooking food at high output power to shorten a cooking time is set in operation 20. If it is determined that the rapid cooking mode is not set, the controller 190 controls the inverter 160 to supply driving power of a predetermined frequency to the working coil 172 to heat food in the cooking container 103 in the induction heating manner in operation 30. At this time, the controller 190 controls the cooling fan motor driving unit 210 to drive the cooling fan motor 150 to perform an operation of discharging heated air through the outlets 105. If it is determined that the rapid cooking mode is set in operation 20, the controller 190 supplies driving power of a predetermined frequency to the working coil 172 through the inverter 160, and supplies driving power to the plane heater 130 through the power supply unit 130, thus heating and cooking food in the cooking container 103 using both the two heat sources 140 and 170 in operation 40. At this time, the controller 190 controls the cooling fan motor driving unit 210 to drive the cooling fan motor 150 to perform an operation of discharging heated air through the outlets 105.

As is apparent from the above description, the present invention provides a composite cooking apparatus and method of controlling the same, which improves thermal efficiency and is not restricted by a cooking container by using a composite heat source at the time of heating and cooking food, thus increasing the convenience in use. Further, the present invention is advantageous in that it may perform heating and cooking using a heat source suitable for material of a cooking container, and perform cooking at high output power using the composite heat source including two heat sources to shorten a cooking time in the case where a rapid cooking mode is set.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A composite cooking apparatus comprising:

two different heat sources to heat food in a cooking container, wherein the heat sources are a plane heater and an induction heater, respectively;

a controller to control operations of heating and cooking the food by operating one or both of the two heat sources according to an operating mode; and a heat resistant glass plate to allow the cooking container to be seated thereon, wherein the plane and induction heaters are mounted below the heat resistant glass plate.

2. The composite cooking apparatus according to claim 1, further comprising an air discharge duct to discharge heated air to outside of the composite cooking apparatus, wherein the plane heater is mounted on a top of the air discharge duct, and the induction heater is mounted below the air discharge duct.

3. The composite cooking apparatus according to claim 2, further comprising a cooling fan motor mounted in the air discharge duct to forcibly blow air heated by heat radiated from the plane heater.

4. The composite cooking apparatus according to claim 2, further comprising a heat insulating material mounted to come into contact with the plane heater in a face-to-face manner to block heat radiated from the plane heater.

5. The composite cooking apparatus according to claim 4, wherein the heat insulating material is made of heat resistant material.

6. The composite cooking apparatus according to claim 5, wherein the heat insulating material is heat resistant up to a temperature of approximately 500° C.

7. The composite cooking apparatus according to claim 4, wherein the heat insulating material is made of material which transmits a magnetic field.

8. A composite cooking apparatus comprising:

two different heat sources to heat food in a cooking container, wherein the heat sources are a plane heater and an induction heater, respectively;

a controller to control operations of heating and cooking the food by operating one or both of the two heat sources according to an operating mode, wherein the controller operates both the plane and induction heaters if an operating mode for shortening a cooking time is set;

a power supply unit to supply driving power to the plane heater;

an inverter to supply driving power of a predetermined frequency to the induction heater; and a current detecting unit to detect current of the inverter, wherein the controller selectively determines at least one of the two heat sources suitable for material of the cooking container depending on the current detected by the current detecting unit.

9. The composite cooking apparatus according to claim 8, wherein the controller determines that the cooking container is suitable for induction heating if the detected current is equal to or greater than a set value, while the controller determines that the cooking container is suitable for plane heating if the detected current is less than the set value.

10. A method of controlling a composite cooking apparatus, the composite cooking apparatus including a plane heater and an induction heater, the method comprising:

setting a cooking command;

heating and cooking food in a cooking container by operating one or both of the two heaters according to the set cooking command;

detecting current of an inverter which supplies driving power the induction heater; and heating and cooking the food selectively using at least one of the plane heater and the induction heater suitable for the cooking container depending on the detected current.

11. The composite cooking apparatus control method according to claim 10, further comprising:

heating food in the cooking container in an induction heating manner if the detected current is equal to or greater than a set value, while heating the food in the cooking container in a plane heating manner if the detected current is less than the set value.

12. The composite cooking apparatus control method according to claim 10, further comprising discharging air heated by the heater to outside of the composite cooking apparatus by driving a cooling fan motor at the time of heating and cooking using the heaters.

13. A composite cooking apparatus on which a cooking container containing food is to be placed, comprising:

a plane heater;

an induction heater; and a controller that determines whether the material of the cooking container is suitable for induction heating depending on a detected current in the induction heater and operates the induction heater if the detected current in the induction heater is equal to or greater than a set value, and the plane heater if the detected current is less than the set value.

14. The cooking apparatus according to claim 13, wherein during a normal cooking mode, one of the plane and induction heaters operate.

15. The cooking apparatus according to claim 14, wherein during a rapid cooking mode, the plane and induction heaters operate.

16. The cooking apparatus according to claim 15, further comprising a cooking command setting unit on a front thereof.

17. The cooking apparatus according to claim 16, further comprising a heat resistant glass plate on an upper casing of the cooking apparatus.

18. The cooking apparatus according to claim 17, wherein the plane heater and the induction heater are below the heat resistant glass plate.

19. The cooking apparatus according to claim 18, wherein the plane heater is on a top of an air discharge duct.

20. The cooking apparatus according to claim 19, wherein the induction heater is below the air discharge duct.

21. The cooking apparatus according to claim 20, wherein the induction heater comprises:

a working coil to generate high frequency current depending on driving power supplied from an inverter; and a support to support the working coil.

22. The cooking apparatus according to claim 21, wherein the working coil is separated from the plane heater.

23. A method of controlling a composite cooking apparatus, including a plane heater and an induction heater, the method comprising:

setting a cooking command;

detecting current at an inverter which supplies driving power to the induction heater;

inductively heating food if the detected current is equal to or greater than a set value; and plane heating food if the detected current is less than a set value.

24. The method of controlling a composite cooking apparatus according to claim 23, further comprising discharging air heated by the heater to outside of the composite cooking apparatus by driving a cooling fan motor at the time of heating and cooking using the heaters.

* * * * *

UNITED STATES PATENT AND TRADEMARK OFFICE

CERTIFICATE OF CORRECTION

PATENT NO. : 6,906,294 B2
DATED : June 14, 2005
INVENTOR(S) : Ha-Yeong Yang

It is certified that error appears in the above-identified patent and that said Letters Patent is hereby corrected as shown below:

Column 7,
Line 40, after "power" insert -- to --.

Signed and Sealed this

Seventh Day of March, 2006

JON W. DUDAS
*Director of the United States Patent and Trademark Office*